US006261109B1

(12) United States Patent
Liu et al.

(10) Patent No.: US 6,261,109 B1
(45) Date of Patent: Jul. 17, 2001

(54) FASTENER FOR ALL-PURPOSE POWER SUPPLY SOCKETS

(75) Inventors: Daniel Liu; Chia-Fu Liu, both of Tao Yuan (TW)

(73) Assignee: Delta Electronics Inc. (TW)

( * ) Notice: Subject to any disclaimer, the term of this patent is extended or adjusted under 35 U.S.C. 154(b) by 0 days.

(21) Appl. No.: 09/286,883

(22) Filed: Apr. 6, 1999

(30) Foreign Application Priority Data

Sep. 28, 1998 (TW) ..... 87216060

(51) Int. Cl.[7] ..... H01R 13/44
(52) U.S. Cl. ..... 439/131; 439/174
(58) Field of Search ..... 439/131, 146, 439/147, 142, 174

(56) References Cited

U.S. PATENT DOCUMENTS 4,997,381 * 3/1991 Oh ..... 439/712
5,613,863 * 3/1997 Klaus et al. ..... 439/131
5,616,051 4/1997 Rogers et al. ..... 439/518
5,829,993 * 11/1998 Wu ..... 439/131
5,973,948 * 10/1999 Hahn et al. ..... 439/146
6,059,584 * 5/2000 Mareno ..... 439/131
6,062,880 * 5/2000 Skuza ..... 439/131

* cited by examiner

*Primary Examiner*—Tulsidas Patel

(57) ABSTRACT

A fastener for all-purpose power supplies sockets includes a socket and at least one plug engageable with the socket. The socket has a latch cavity in a lateral wall. The plug has a moveable fastening member that has a first button engaging with a latch bar. The latch bar has a latch head engageable with the latch cavity and a latch tail engageable with a spring strip. The latch head may engage with the latch cavity automatically when the plug is inserted in the socket to form a secure engagement and coupling. Upon moving the first button sideward, the latch head will be disengaged with the latch cavity to enable the plug to move away from the socket easily.

16 Claims, 6 Drawing Sheets

FASTENER FOR ALL-PURPOSE POWER SUPPLY SOCKETS

BACKGROUND OF THE INVENTION

1. Field of the Invention

This invention relates to a fastener for all-purpose power supply sockets, and more particularly to a fastener including a moveable member for engaging or disengaging a plug from the socket easily.

2. Description of the Prior Art

A conventional all-purpose power supply socket usually has a common socket to support a variety of plugs, in which every plug has a first end to connect with the socket and a second end to connect with a power source. Generally, the all-purpose socket in the art includes a plug-type insert as a receptacle for electrically engaging with the first end of the plug. The second end of the plug may be embodied as a three-port plug, a two-port plug, a vertical-board type plug, or any plug type known in the art.

In conventional art, coupling of the socket and the plug is usually simply done by engaging the insert of the socket and the first end of the plug. U.S. Pat. No. 5,616,051 is one of such examples. Although such a type of engagement of the socket and the plug can provide a simple connection structure, yet it is quite possible that the engagement becomes looser and looser after long-term usage; especially after experiencing frequently engaging and disengaging operations. To remedy this problem, some fastening means between the socket and the plug have been introduced recently. U.S. Pat. No. 5,613,863 is one typical example for applying such fastening means.

However, the fastening means disclosed in U.S. Pat. No. 5,613,863 has an integrally formed plastic plug body (i.e., by associating part numbers 630,636 and 638 and the cavity 218). Due to the plastic material, the fastening means have limitation on applicable dimensions and deflection. It hence cannot be manufactured to a substantial size for facilitating manual operation. Also, because of material used and integral production property, it usually does not have enough strength to withstand fatigue fracture (e.g., it is prone to rupture at the root).

SUMMARY OF THE INVENTION

In view of aforesaid disadvantages, it is therefore an object of this invention to provide a fastener for all-purpose power supply sockets that has an independent fastening member to enable easy operation of a plug into a socket and making the whole unit more durable.

It is another object of this invention to provide an insert positioning means for the power supply socket that includes angular bulges and a recess to make assembly of the socket easier.

It is a further object of this invention to provide a socket conversion means to enable the insert of a plug having more than one type of outlet to suit different requirements.

The fastener according to this invention includes a socket and at least one plug.

The socket has a receptacle formed in a casing for receiving the plug. In the receptacle, there is provided with an insert that has a pair of terminals extending toward a top opening of the receptacle.

The plug has one end equipped with power terminals for coupling with an external power source and another end having slot-type openings for engaging with the receptacle.

The slot openings, terminals and power terminals form an electric connection.

The fastening means according to this invention includes a latch bar located at the plug and a latch cavity located in a rear wall of the receptacle. The latch bar has a latch head formed at one end for engaging with the latch cavity, a latch tail formed at another end for engaging with a spring strip, and a first button located above the latch bar to enable a user in disengaging the latch head from the latch cavity when desired.

In one aspect of this invention, the latch cavity is formed in a wedge shape. The receptacle may have a transverse stop bar to prevent undesirable objects from entering in or making contact with the insert.

In another aspect of this invention, a conversion plug may be provided to engage with the receptacle. The conversion plug has slot openings at one end to couple with the terminals of the insert in the receptacle and a conversion socket formed at another end thereof for connecting with an external power source. The conversion socket, which is electrically connected with the slot openings, may be a socket of any standard specification.

In a further aspect of this invention, the insert may include an insert body pivotally engaged with the receptacle so that the insert may rotate in the receptacle. An angular means and a positioning means may be provided respectively to the insert body and the receptacle for enabling the insert to rotate among predetermined angles and to anchor at one of the angles. The positioning means may include a tongue-like member formed on the rear wall of the receptacle for providing an elastic engagement with the insert to facilitate rotation and positioning of the insert. The tongue-like member may be formed by cutting a U-shaped groove on the rear wall of the receptacle. Of course, other shape of groove may also be used. The positioning and angular means of this invention may be embodied as positioning bulges and an angular recess respectively, or vice versa (e.g., positioning recesses and an angular bulge respectively).

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
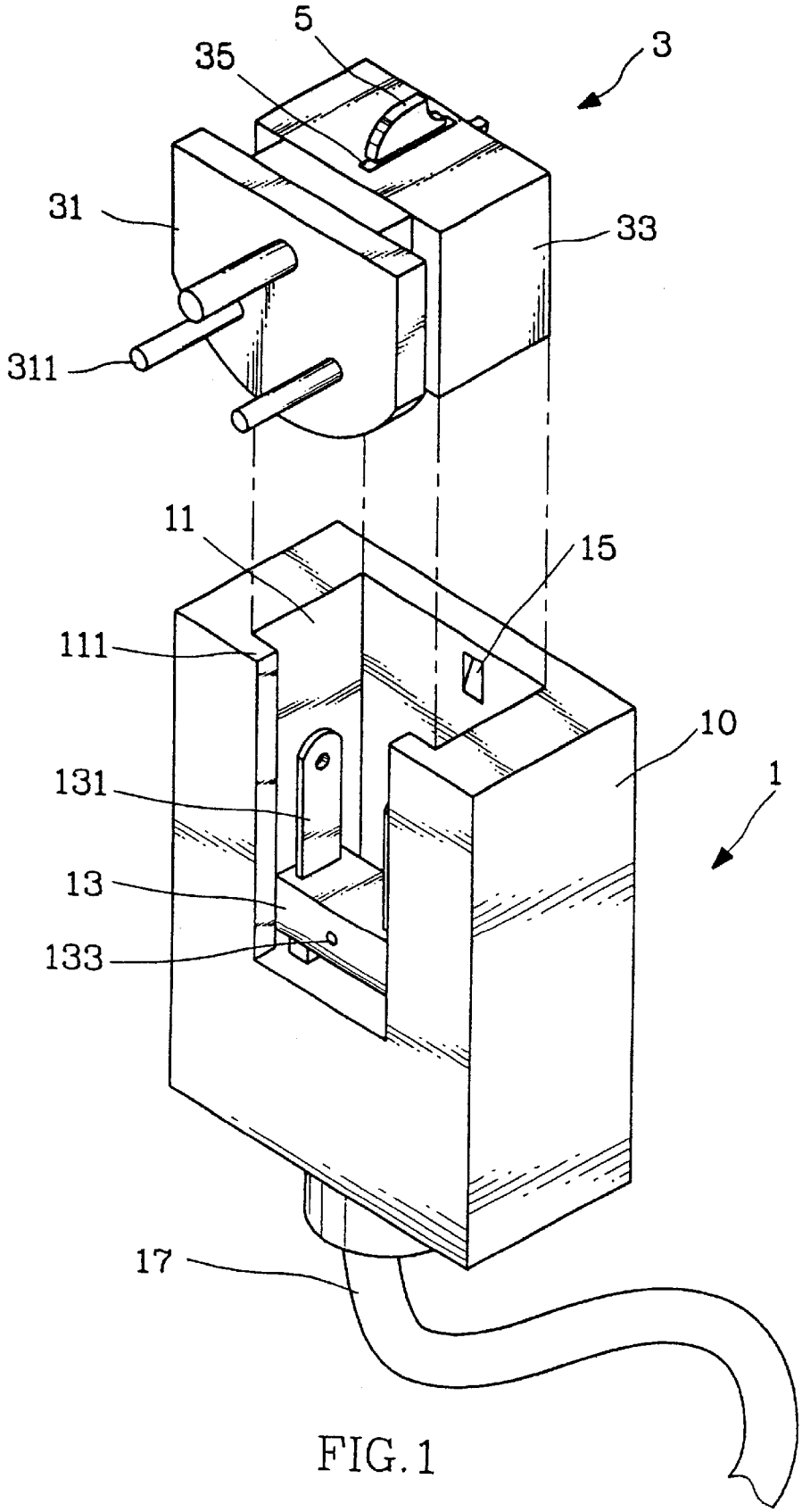
FIG. 1 is an exploded perspective view of a plug and a respective socket utilizing a fastener of this invention.
Figure 2:
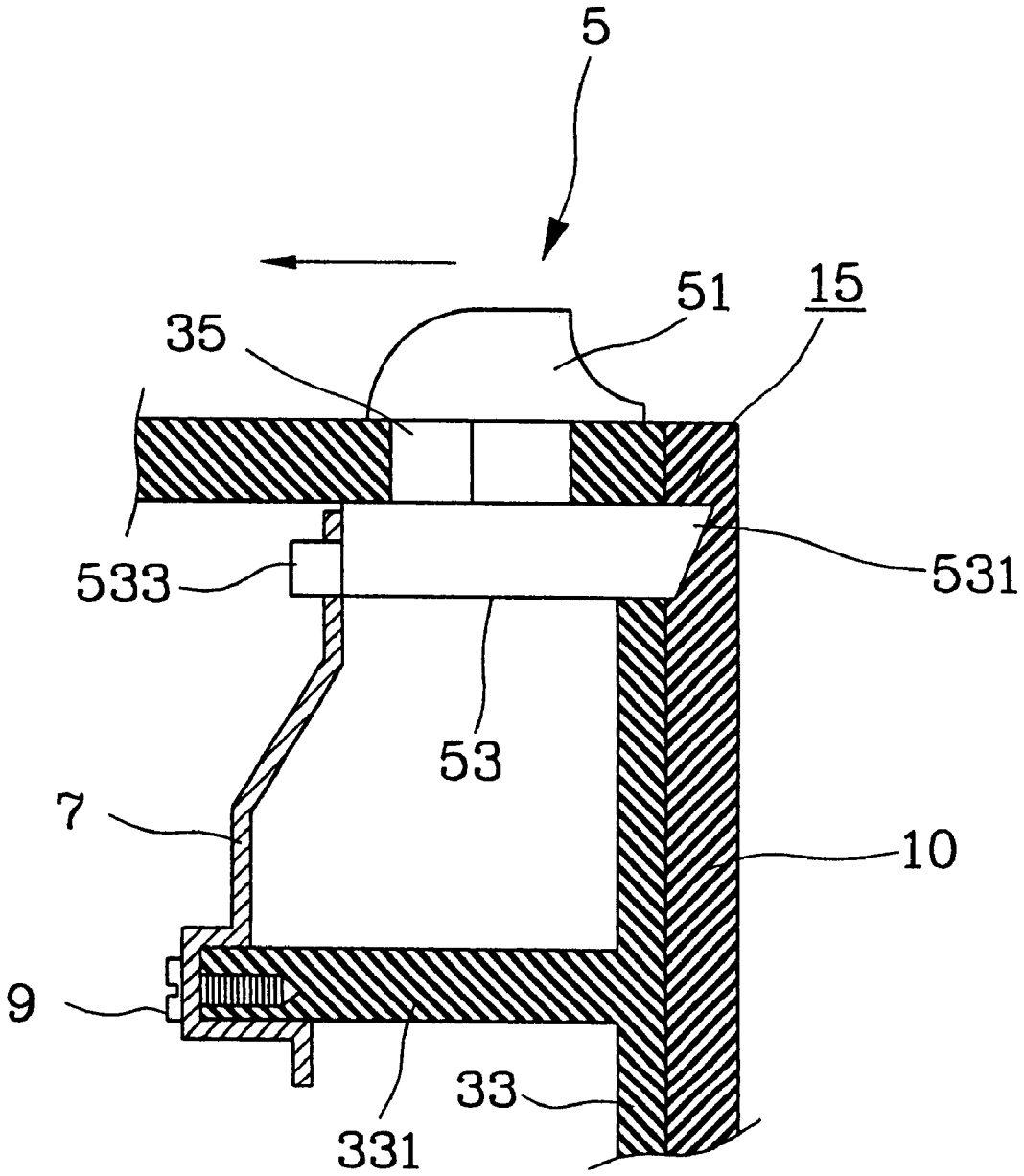
FIG. 2 is a fragmentary sectional view of a fastener of this invention.

Referring to FIGS. 1 and 2, the fastener of this invention includes a first fastening member 5 located in a plug 3 and a latch cavity 15 formed in a rear wall of a receptacle 11 located in a socket 1. The socket 1 has a casing 10 housing the receptacle 11 therein and a power cable 17 at one end of the casing 10 for connecting with an electric device desired.

Beside the rear wall, the receptacle 11 has two side walls, a top opening and a front opening which has two side flanges 111 for holding the plug 33 securely in the receptacle 11. Inside the receptacle 11, there is an insert 13 which has a pair of spaced conductive terminals 131 that in turn have a bottom end electrically connecting with the power cable 17. The terminals 131 may couple with the plug 3 vertically from the top opening as shown in FIG. 1. The insert 13 may also be turned 90 degrees to have the terminals 131 laid horizontally to couple directly with an external power source through the front opening.

The plug 3 includes a power source end 31 upon which two or three power terminals 311 may be provided to couple with an external power source and a body 33 for being mounted into the receptacle 11. At the bottom of the body 33, there are slots (not shown in the figures) engageable with the terminals 131 to establish electrical connection between the external power source with the electric device through the power terminals 311, terminals 131 and power cable 17. At the engaged position, the first fastening member 5 engages with the latch cavity 15 as shown in FIG. 2. Following description will offer more details of their structural relationship.

The first fastening member 5 is movable in a fastener slot 35 formed in a top wall of the body 33. It has a first button 51 at the top thereof and a first latch bar 53 at the bottom. The first latch bar 53 further has a latch head 531 with a slant-in front side at one end and a latch tail 533 at another end. The latch tail 533 further engages with a spring strip 7 which is fixed to a first spring mounting 331 extended from the rear wall of the body 33.

When the plug 3 is not in use and is separated from the socket 1 as shown in FIG. 1, the spring strip 7 restrains the latch bar 53 at the latch tail 533 to have the latch head 531 protruding out of the rear wall of the body 33.

While sliding the body 33 of the plug 3 into the receptacle 11 of the socket 1, the slant front side of the latch head 531 is firstly pushed by the rear wall to move the latch bar 53 backward against the spring strip 7, and the latch bar 53 resumes its original state (as shown in FIG. 2) as soon as the latch head 531 engages with the latch cavity 15. At the position shown in FIG. 2, the spring strip 7 presses the latch tail 533 to its original state so that the latch bar 53 may engage securely with the latch cavity 15. The plug 3 thus may be held securely in the receptacle 11 of the socket 1.

When there is a need to disengage the electric device from the power source, the first button 51 is pushed in the direction toward the latch tail 533. Upon moving the first button 51 backward, the latch head 531 will be moved away from the latch cavity 15. The plug 3 is then free to move out of the receptacle 11. The first button 51 may be made in a desirable size and shape to make the operation simple and easy.

In another embodiment of the fastener (not shown in figures), the latch cavity 15 may be located in a side wall of the receptacle 11 rather than in the aforesaid rear wall shown in FIG. 1. In such an event, the latch bar 53 and latch head 531 should also be arranged correspondingly to engage with a side latch cavity.

The spring strip 7 may be made of selective material and size for providing the latch bar 53 with adequate strength in engaging with the latch cavity 15. The latch cavity 15 and the latch head 531 may be formed in any desired shape such as wedge, barrel, square, triangle and the like.

Due to the material property of the metal used for spring strip 7, enough engaging force can be provided for the fastener of the present invention, and the fatigue and rupture problem in a conventional plastic-made fastener can be avoided. The first button 51 may be located at the top of the body 33 and can be arranged far away from the engaging position of the plug 3 and the socket 1. Such an arrangement offers more flexibility in the design on the dimension and shape of the plug 3 and the socket 1.

Figure 3:
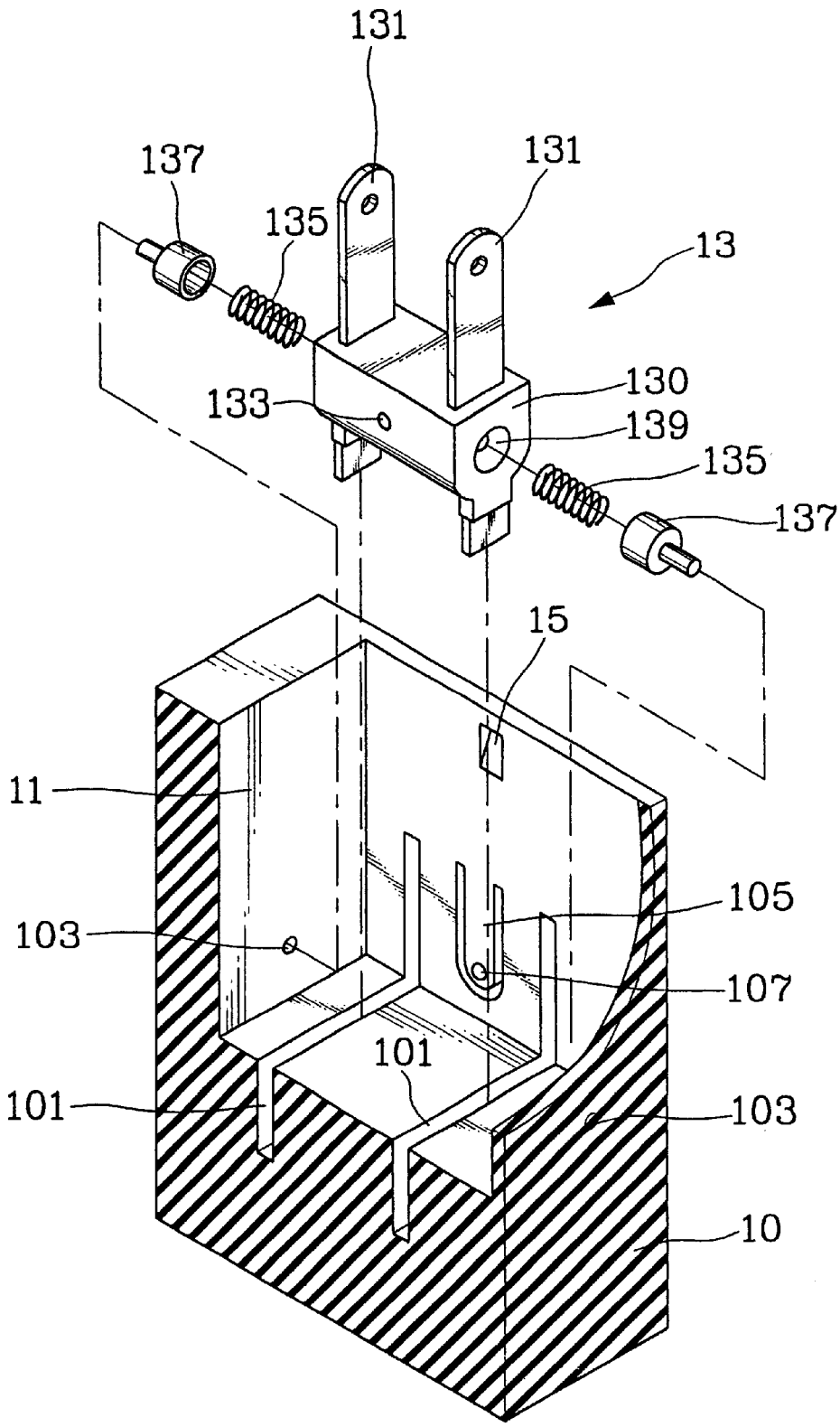
FIG. 3 is an exploded view of an embodiment of the insert of the invention.

FIG. 3 illustrates another embodiment of this invention. The insert 13 has an insert body 130 that has angular recesses 133 formed symmetrically in the front, bottom and rear sides thereof. On the rear wall of the receptacle 11 and below the latch cavity 15, there is a positioning bulge 107 which is engageable with one of the angular recesses 133 so that the insert 13 may be positioned in the socket casing 10 precisely and quickly at a desired angle. FIG. 3 also shows an embodiment variation of this invention. At opposing lateral sides of the insert body 130, there are two spring bores 139 formed therein; bore one 139 on each lateral side. Each spring bore 139 is used to hold a spring 135 and a spring head 137. The spring head 137 has one end forming a spindle manner which is pivotally engageable with one of two apertures 103 located in the corresponding lateral walls of the receptacle 11. Therefore, the insert 13 may be pivotally held in the receptacle 11 by means of the spring heads 137. The insert 13 is then able to turn about the apertures 103 from a vertical position to a horizontal position. The socket casing 10 has a pair of respective terminal slots 101 below the insert 13 to enable the lower portion of the terminals 131 be accommodated therein when the insert 13 is turned. The terminal slots 101 may have conductive contact with the lower ends of the terminals 131 and also forming conductive connection with the power cable 17.

In order to make the rotation of the rotational insert 13 smooth and durable, the rear wall of the receptacle 11 may form a tongue-shaped elastic arm 105 with the positioning bulge 107 located at the free end of the arm 105. The elastic arm 105 may be formed by cutting a U-shaped through groove in the rear wall of the socket casing 10. The bulge 107 is thus capable of elastic engagement with one of the angular recesses 133 when the insert 13 rotates and contacts against the arm 105.

Of course, in the embodiment of the recesses 133 and bulge 107, the position of the angular recesses 133 and the positioning bulge 107 may be switched with each other and still achieve same result. That is, the bulges are formed on the locations where the recesses 133 are located and a recess is formed on the location where the bulge 107 is located.

Figure 4:
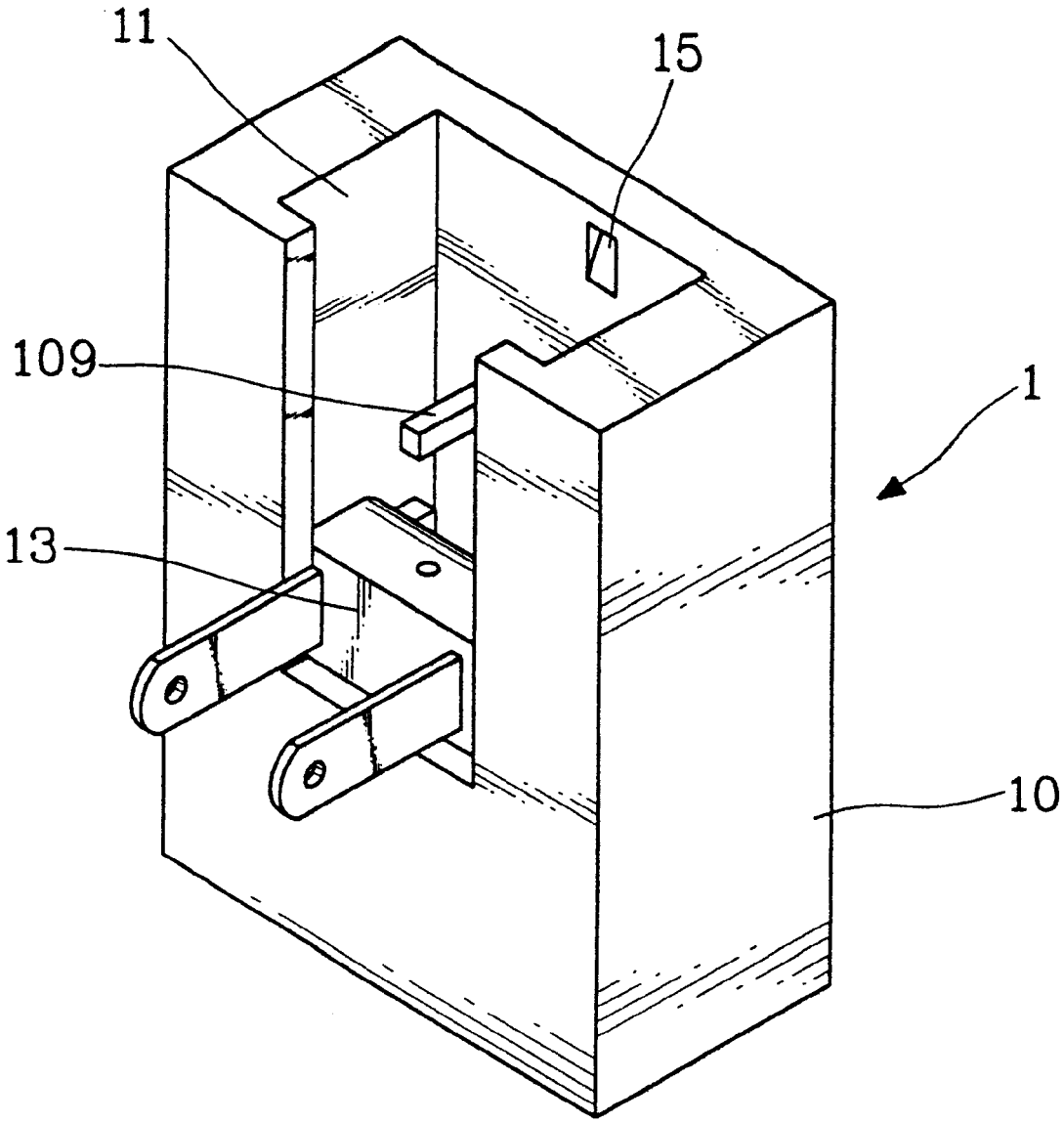
FIG. 4 is a perspective view of another embodiment of the socket of the invention.

FIG. 4 illustrates a further embodiment of this invention. In the receptacle 11, there is provided with a horizontal stop bar 109 located above the insert 13; so that any undesirable objects may be prevented from dropping into the receptacle 11 and making contact with the insert 13. In this embodiment, the plug body 33 should have a respective slot opening to enable the stop bar 109 to pass through during assembly.

Figure 5:
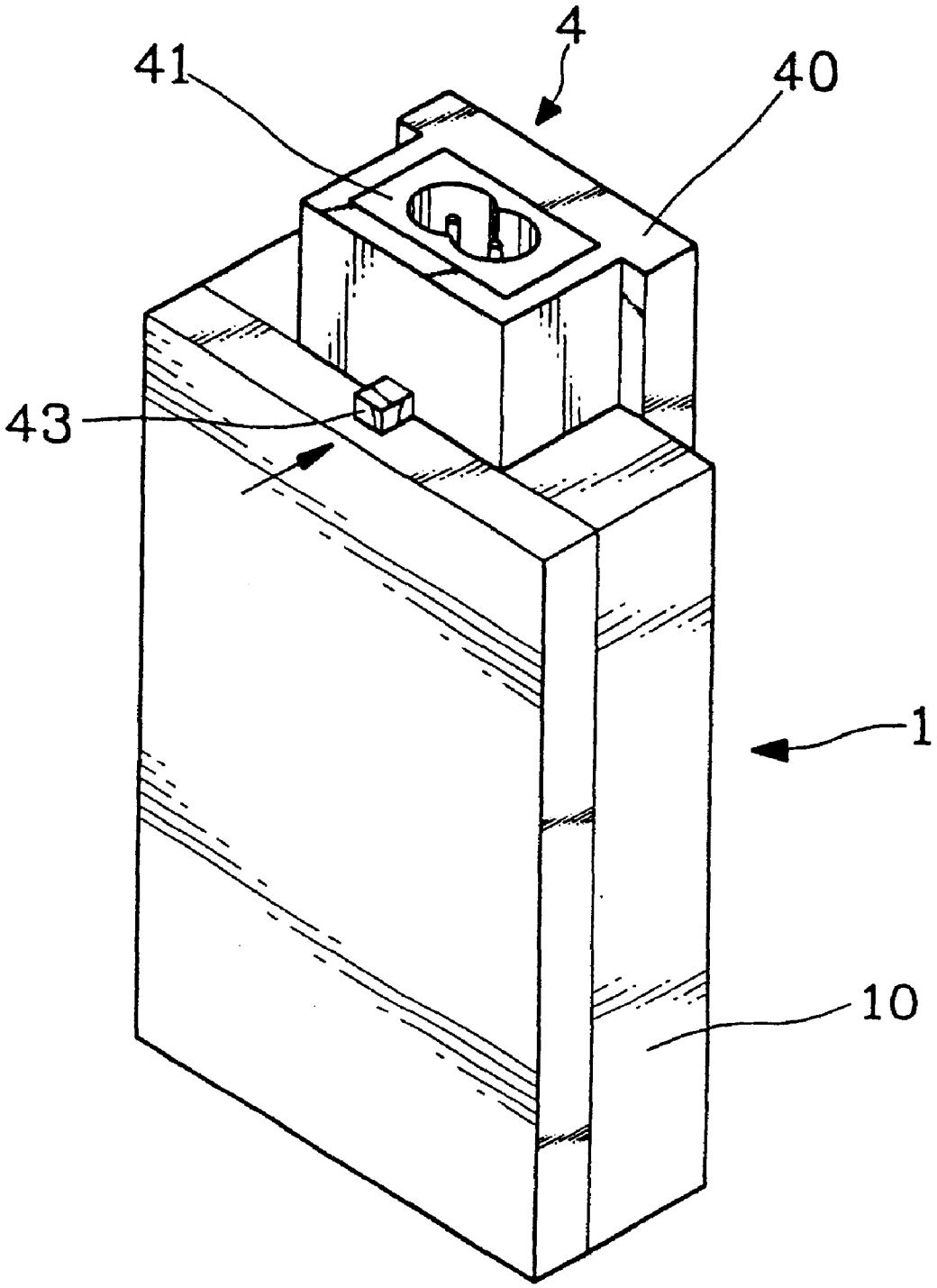
FIG. 5 is a perspective view of a conversion socket of this invention.
Figure 6:
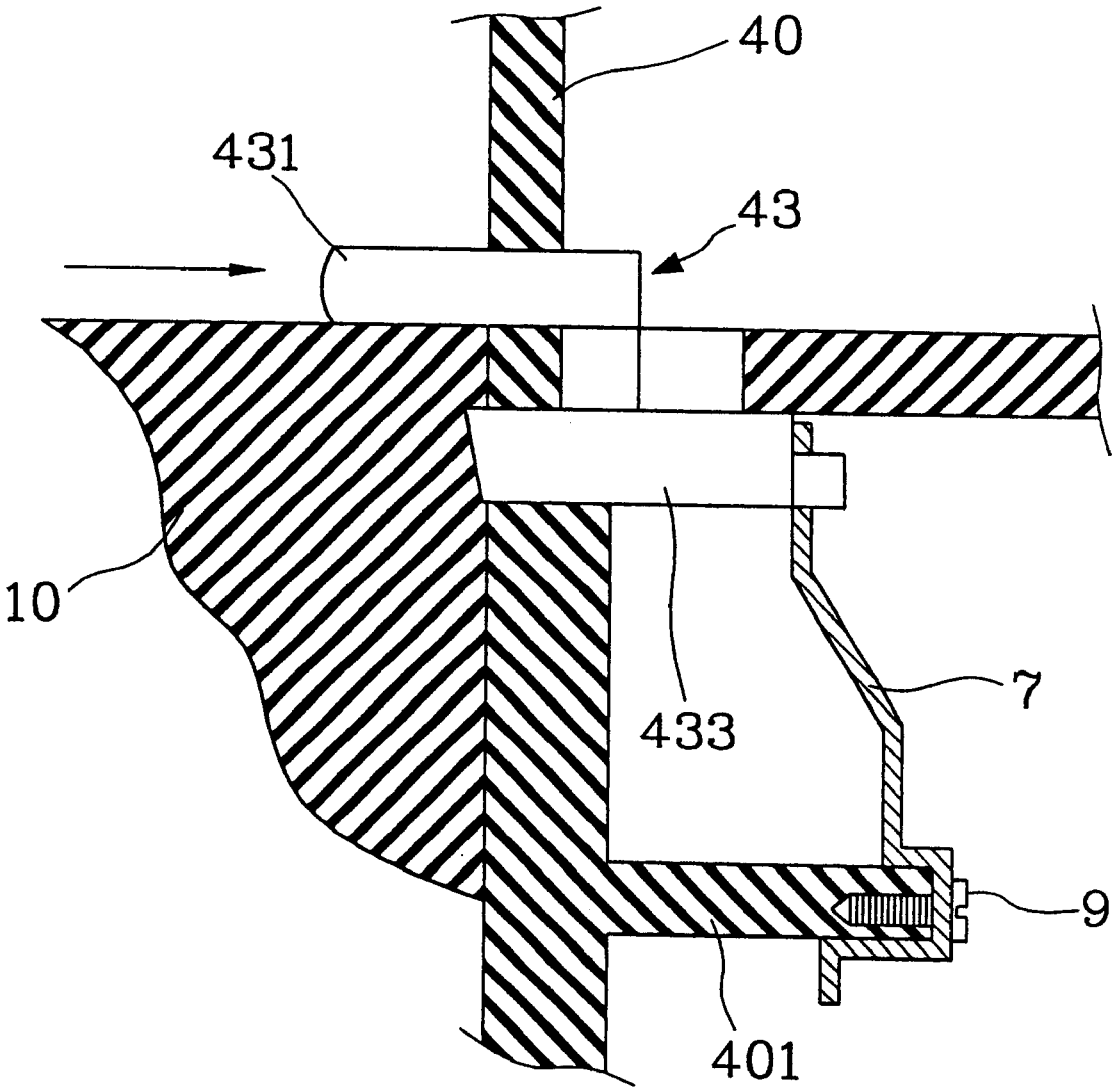
FIG. 6 is a fragmentary sectional view of the fastener shown in FIG. 5.

FIGS. 5 and 6 show yet another embodiment of this invention for the socket 1 engaging with a conversion plug 4 capable of converting outlet of the aforesaid insert 13 to another type of outlet for connecting with a different power supply.

The engagement of the conversion plug 4 and the receptacle 11 is mostly like the one set forth above. However in the casing 40, there is a conversion socket 41 that may couple with the terminals in the socket 1 to establish an electric link. The conversion socket 41 is preferably made by any standard specification such as a two-port type, three-port type, or any other type that conforms industry standards.

In the conversion plug 4 as shown, there is a movable second fastening member 43 that includes a second button 431 exposed outside the plug 4 and a second latch bar 433, in which the second latch bar 433 also has a latch head engageable with the socket casing 10 and a latch tail 7 engageable with a spring like the embodiment shown in FIG. 2. Both embodiments (i.e., those in FIGS. 2 and 6) basically provide the same function and effect already set forth above. The main difference is the size and location of the second button 431 and the first button 51. Apparently, in the application of the present invention, the location and the size of the fastener can be various embodied, and be determined upon deciding the power supply types and design requirements.

It may thus be seen that the objects of the present invention set forth herein, as well as those made apparent from the foregoing description, are efficiently attained. While the preferred embodiments of the invention have been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. An assembly, comprising:

a socket having a casing with a receptacle therein and an insert inside the receptacle; the receptacle including a rear wall, a bottom wall and two side walls for forming a top opening; the rear wall having a latch cavity formed therein; the insert located on the bottom wall and electrically coupling with a power cable through the bottom wall; and at least one plug having a power source end engageable with an external power source and a body engageable with the receptacle for the power source end to be electrically coupling with the insert; the body having a fastening member which includes a movable first button located above a top of the body, a latch bar engaged with a bottom of the first button, a latch head located at one end of the latch bar and engageable with the latch cavity, a latch tail located at another end of the latch bar, a spring mounting extending from the rear wall, and a spring strip mounted at one end thereof on the spring mounting and another end thereof engageable with the latch tail;

wherein the latch head engages the latch cavity when the plug is inserted into the socket; and upon moving the first button against the spring strip, the latch head disengaging with the latch cavity so that the plug may be moved out of the socket.

2. The assembly of claim 1, wherein the latch cavity is of a wedge shape.

3. The assembly of claim 1, wherein the socket has a transverse top bar for preventing an external object from dropping into the receptacle or making contact with the insert.

4. The assembly of claim 1, wherein the plug includes a conversion plug having one end engageable with the insert to form an electrical connection and another end thereof forming a conversion socket for coupling with the external power source.

5. The assembly of claim 1, wherein the insert has an insert body which has a pair of terminals located at a top thereof and two lateral ends pivotally engaged with the socket, the insert body further having a plural number of angular recesses symmetrically formed on a front side and a rear side thereof, the angular recesses being engageable with a positioning bulge located on the rear wall of the socket at the shortest space distance from the insert body.

6. The assembly of claim 5, wherein the rear wall further has a non-closed loop through-wall groove formed around the positioning bulge to form an elastic arm for engaging elastically with one of the angular recesses when the insert is turned in the socket.

7. The assembly of claim 6, wherein the non-closed loop through-wall groove is a U-shaped groove.

8. The assembly of claim 1, wherein the insert has an insert body which has a pair of terminals located at a top thereof and two lateral ends pivotally engaged with the socket, the insert body further having a plural number of angular bulges symmetrically formed on a front side and a rear side thereof, the angular bulges being engageable with a positioning recess located on the rear wall of the socket at the shortest space distance from the insert body.

9. The assembly of claim 8, wherein the rear wall further has an non-closed loop through groove formed around the positioning recess to form an elastic arm for engaging elastically with one of the angular bulges when the insert is turned in the socket.

10. The assembly of claim 9, wherein the non-closed loop through groove is a U-shaped groove.

11. An assembly, comprising:

a socket having a casing with a receptacle therein and an insert located inside the receptacle; the receptacle formed by a rear wall, a bottom wall and two side walls for having a top opening; the insert further having an insert body pivotally mounted between the two side walls and spaced from the rear wall; the insert body having terminals vertically located on a top thereof and an angular means symmetrically located on a front and a rear side thereof; the angular means being engageable with a positioning means located on the rear wall when the insert is turned; the rear wall further has a non-closed loop through groove formed around the positioning means to form an elastic arm for engaging elastically with the angular means when the insert is turned in the socket; and at least one plug having a power source end engageable with an external power source and another end engageable with the insert to form an electric connection.

12. The assembly of claim 11, wherein the non-closed loop through groove is a U-shaped groove.

13. The assembly of claim 11, wherein the positioning means and the angular means are respectively a positioning bulge and an angular recess.

14. The assembly of claim 11, wherein the positioning means and the angular means are respectively a positioning recess and angular bulges.

15. The assembly of claim 11, wherein the non-closed loop through groove is a U-shaped groove.

16. The assembly of claim 15, wherein the socket has a conversion plug that has a first end engageable with the insert to form an electrical connection and a second end forming a conversion socket coupled with the first end and engageable with an external power source.

* * * * *